US005871689A

United States Patent [19]

Röllin et al.

[11] Patent Number: 5,871,689

[45] Date of Patent: Feb. 16, 1999

[54] DEVICE FOR HOLDING BILLETS

[75] Inventors: Erich Röllin; Hansjörg Huber, both of Neuhausen; Jean-Pierre Gabathuler, Schleitheim, all of Switzerland

[73] Assignee: Alusuisse Technology & Management Ltd., Switzerland

[21] Appl. No.: 754,838

[22] Filed: Nov. 22, 1996

Related U.S. Application Data

[63] Continuation of Ser. No. 547,458, Oct. 24, 1995, abandoned.

[30] Foreign Application Priority Data

Nov. 22, 1994 [CH] Switzerland ..... 03516/94

[51] Int. Cl.[6] ..... C21B 3/00

[52] U.S. Cl. ..... 266/274

[58] Field of Search ..... 266/274, 275, 266/276, 277; 432/262, 264, 265

[56] References Cited

U.S. PATENT DOCUMENTS 964,871 7/1910 Johnson ..... 432/262

*Primary Examiner*—Scott Kastler
*Attorney, Agent, or Firm*—Bachman & LaPointe, P.C.

[57] ABSTRACT

Holding device for inductive heating of billets of metal alloys having thixotropic properties, and for holding and transporting the billets until casting. The holding device is a dish and the dish exhibits a body in the shape of a tub and a wall at each end, at least the body being out of a high melting point metal, for example steel.

16 Claims, 1 Drawing Sheet

DEVICE FOR HOLDING BILLETS

This is a Continuation, of application Ser. No. 08/547,458, filed Oct. 24, 1995, now abandoned.

BACKGROUND OF THE INVENTION

The present invention relates to a holding device for inductive heating of billets of metal alloys having thixotropic properties, and for holding and transporting the billets until casting, The invention also relates to the use of the holding device.

Known are e.g. billets or preforms of metal alloys that are manufactured by melting and continuously casting a metal alloy. The melted alloy is processed e.g. by strong stirring at controlled temperature to a semi-solid alloy state in which the partially melted dendritic primary, solid particles are surrounded by a matrix of liquid metal. This semi-solid alloy mix is cast into elongated ingots, under the influence of stirring, and cooled. The ingots may be processed further in this form, worked into preforms or divided into billets. Processing the ingots, preforms or, in particular, billets may take place for example by e.g. heating a billet such that it reaches a semi-solid, in particular thixotropic, state and then working the billet into a shaped form. This shaping process may be in the form of extrusion, forging or casting. Technologies of this kind are known e.g. from the German patent document DE-PS 22 29 453; technical refinements to this are recorded e.g. in DE-PS 30 06 618. The patent document EP 0 131 175 describes a process for continuous production of metal shapes. To manufacture metal shapes, free-standing metal preforms are heated until reaching a semisolid state i.e. the preforms stand free and the temperature is maintained at a level at which the preform is partially solid. The preforms are transferred by a carrying facility to the shaping facility, said transfer taking place without any significant deformation of the preform and without any significant variation in the semi-solid fraction within the preform. The transfer takes place in particular by means of mechanical gripping. Described in EP A 0 513 523 is another casting process in which the metallic melt is brought into a semi-solid state by means of a static mixer and cooled. The billets produced in this manner are heated e.g. in a stainless steel container and fed into the casting chamber of a casting machine.

During the heating up stage it is decisive that various requirements are satisfied in order for the best quality of billet and end product to be achieved. This concerns e.g. uniformity with respect to maintaining the shape of the semi-solid billet and a uniform distribution of temperature in the billet. Also desired is low metal loss e.g. due to metal dripping off the billet, rapid heating up, in order that no grain growth takes place and an exact and reproducible condition at temperature.

SUMMARY OF THE INVENTION

The object of the present invention is to propose a device which meets these requirements and may be used with billets, also known as preforms, manufactured in any kind of manner.

That object is achieved by way of the invention in that the holding device is a dish and the dish exhibits a body in the shape of a tub and a wall at each end, at least the body being out of a high melting point metal.

The body of the dish is tub-shaped, the cross-section of the tub shape being a part of a circle or part of an oval with continuing walls that may be vertical to inclining outwards slightly, or the cross-section of the body is essentially tube-shaped and is such that the cross-section of the body describes a part of a circle with a sector angle of e.g. 120° to 210°, with reference to 360° (degrees of angle) for the whole tube-shaped cross-section. Preferred is a fraction of the body making up 150° to 180°. Correspondingly, the fraction making up the opening amounts to 240° to 150°.

Usefully, the holding device is in the form of a shell with a tub-shaped body of round to oval cross-section and the billet has a round to oval cross-section, and the billet is accommodated in the holding device in the lying position.

Further, preferred is a holding device which is in the form of a dish with a tub-shaped body that is round to oval in cross-section and the billet is accommodated in the holding device in the lying position, and the length of the billet is greater than the largest diameter of the billet.

BRIEF DESCRIPTION OF THE DRAWINGS

The present invention will be more readily understandable from a consideration of the accompanying drawings, in which.

DETAILED DESCRIPTION OF PREFERRED EMBODIMENTS

Figure 1A:
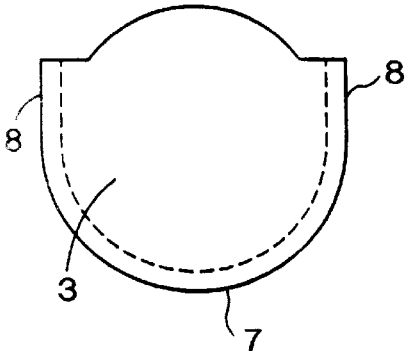
FIG. 1A and FIG. 1B are end and front views of a holding device of the present invention.

As a rule the billets are round in cross-section, they may however also be oval in cross-section or polygonal in cross-section, and may have e diameter e.g. of 50 mm to 150 mm, and the length may be e.g. 80 mm to 500 mm.

According to the present invention an advantageous holding device is such that it has a shell with a body and at each end of the body an end wall, where the body and one or both end walls contain or are made of a high melting point metal of the series: iron-carbon-containing metals such as steel, stainless steel, "Thermax" steel, hot working steel or of the series tantalum, niobium, vanadium, tungsten or titanium or alloys thereof. The choice of high melting point metal depends on the metal to be processed, and the softening point of the high melting point metal should be adequately greater than the temperature at which the billet is to be processed.

The dish exhibits in particular a body and at each end of the body an end wall, and one or both end walls may preferably contain or be of ceramic materials. Suitable ceramic materials are e.g. $Al_2O_3$, $Al_3O_4$, BN, SiC, $Si_3N_4$, MgO, TiO, $ZrO_2$, stabilized, such as yttrium-stabilized $ZrO_2$, glasses or refractory cements or mixtures that contain the above mentioned materials The end walls may preferably be of fiber-reinforced ceramic material, or contain such materials, and the fibers of the fiber-reinforced ceramic material may be e.g. of SiC, $Al_2O_3$, glass or carbon.

The end walls may also be made up of combinations of the above mentioned metals and ceramic materials.

The end walls may e.g. be plate, disk or mussel shaped and be flush with the body or project beyond the cross-section of the body. The extra part of the end wall may be facing the opening in the dish and the end walls may at the same time form feet that prevent the dish from rolling or tilting.

As described above, the dish is tub-shaped with a round to oval cross-section and the billet likewise exhibits a round to oval cross-section, the inner diameter of the body being 0.2 to 10 mm larger than the largest diameter of the billet. The length of the shell is usefuilly 1 to 10 mm larger than the maximum length of billet. The height of the shell is for example 0 to 60 mm greater than half of the diameter of the billet. The end walls may e.g. be disk-shaped and the height of the end walls may be 30 mm smaller to 20 mm larger than the diameter of the billet. The thickness of the body of the shell may e.g. be 0.5 to 5 mm, and the wall thickness of the ceramic material of the end wall may be e.g. 2 to 15 mm. Typical examples of dishes that are used in practice exhibit a length of approx. 80 mm to 530 mm and a diameter of approx. 50 mm to 170 mm.

The dish may in some cases exhibit devices which enable the dish to be gripped by hand or a mechanical device, transported, emptied and finally cleaned; the dish may also exhibit devices which correspond to holding or transporting devices in the heating facility. This may e.g. be hook or ring-shaped elements or pins, bolts or the like which are shaped on or mounted on the body or are shaped on or mounted on the end walls.

The holding device according to the invention is employed for inductive heating of billets of a metal alloy with thixotropic properties and for holding and transporting the billets until casting. The heating up of the billet is very important as the condition of the billet i.e. its strength is available only in a very small temperature range, and long heating up times must be avoided. If the billet is too warm, the metal alloy becomes too fluid or too pasty; if the billet is too hard, then it can not be processed or if so then only poorly.

During the heating of vertical standing preforms according to the present state-of-the-art, it is almost impossible to prevent at least small amounts of metal from dripping out of the billet. This has consequences in that this metal is no longer available for processing, and has to be recycled. In addition, the variable amount of metal leaking out leads to irregular billet conditions i.e. the heavier billet or the billet with less leakage is harder at the end of the heating up stage. With the holding device according to the present invention these difficulties are overcome in a simple manner. The billet lying down is not deformed by its own weight, and the risk of leakage of liquid metal from the billet is minimized. As no metal leaks out, the amount of metal is constant and the energy fed to the billet is distributed uniformly in the pre-calculated amount of metal. Transporting the billet in the holding device to the facility for processing it is without problem as the billet in the pasty form is supported to a large degree by the holding device. Holding devices according to the invention usefuilly feature a shell with end walls made of ceramic material. The advantage of this is that the induced currents do not, or only to a small degree, penetrate the ceramic material so that the ends of the billet are not subjected to an energy input from the side walls. As the thermal radiation of the ceramic material is small, uniform distribution of heat in the billet is achieved to a greater degree.

A further advantage of the present holding device is the use of a high melting point metal at least for the body. The body heats up quickly and releases no foreign material, such as ceramic oxides and the like, to the billet; also no foreign materials are transferred with the billet into the casting chamber.

The holding device according to the present invention serves for inductive heating of billets or preforms out of metals such as e.g. iron and steel, copper, magnesium, zinc or aluminum and alloys of these metals.

Figure 1B:
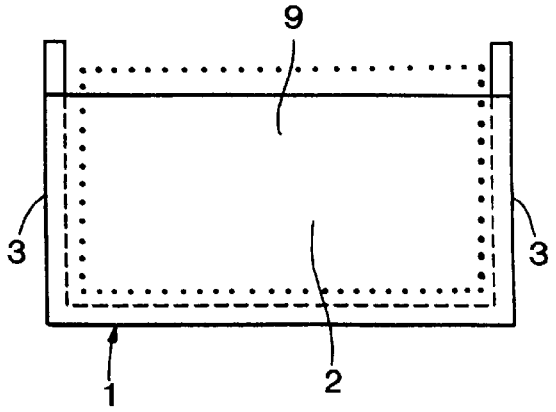

FIG. 1 shows an end view and a front elevation of one example of the holding device according to the invention for billets (shown in dotted lines in FIG. 1B) of metal alloys having thixotropic properties. The dish 1 features a body 2 and end walls 3 made of high melting point metal. The end walls 3 may be attached to the body 2 e.g. by welding. The body 2 is tub-shaped. The inner cross-section of the body 2 forms approximately a semi-circle 7, and end walls 3 standing vertical and parallel to each other are provided on both sides of the semi-circle.

Figure 2A:
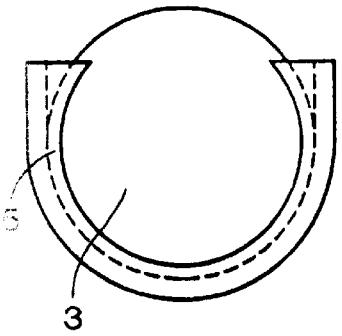
FIG. 2A and FIG. 2B are end and front views of another embodiment of a holding device of the present invention.
Figure 2B:
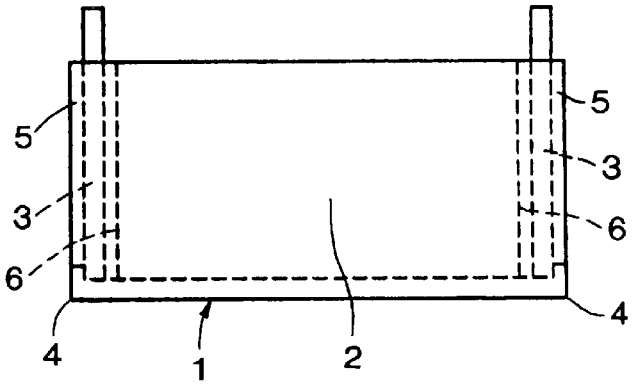

FIG. 2 shows an end view and a front elevation of another exemplified holding device according to the invention for billets of metal alloys having thixotropic properties. The shell comprises a body 2 which is essentially tub-shaped in cross-section and is of a high melting point metal. Mounted at the ends 4 of the body are ring-shaped closures 5 which form the stops for the end walls 3 that are made of ceramic material. The end walls are fixed by a seam 6 of refractory cement. The end walls 3 of ceramic material. or also out of high melting point material may, in an alternative version, be inserted for example in grooves at the edge of the body 2 and held fast e.g. by the spring action of the body, or cemented in by refractory cements or the metals may be welded together.

The present invention relates also to the use of the holding device for heating billets of a metal alloy, which has thixotropic properties, up to a temperature range in which the billets are in a semi-solid state, holding them in an induction heated furnace, and transporting the billets until casting.

We claim:

1. Billets of metal alloys having thixotropic properties and holding device for inductive heating of said billets, and for holding and transporting the billets until casting, in combination, which comprises: a holding device which is a dish, wherein said dish exhibits a body in the shape of a tub with a wall at each end and with an unobstructed opening permitting loading of billets therein, at least the body being of a high melting point metal, wherein the cross-section of the body is essentially tube-shaped and is such that the cross-section of the body describes a part of a circle with the body making up a sector angle of 150°–180° for the whole tube-shaped cross-section, and including a billet having thixotropic properties in the holding device.

2. Holding device and billets according to claim 1, wherein the holding device is a shell with a tub-shaped body, the cross-section of the tub-shape being part of a circle or part of an oval with continuing walls that may be vertical to slightly inclining outwards.

3. Holding device and billets according to claim 1, wherein the billet has a round to oval cross-section and is accommodated in the holding device in the lying position, and the length of the billet is greater than the largest diameter of the billet.

4. Holding device and billets according to claim 1, wherein at each end of the body is an end wall, where the body and at least one of said end walls contains high melting point metals.

5. Holding device and billets according to claim 4, wherein said high melting point metals are iron-carbon containing metals selected from the group consisting of steel, stainless steel, Thermax steel and hot working steel.

6. Holding device and billets according to claim 4, wherein said high melting point metals are selected from the series tantalum, niobium, vanadium, tungsten, titanium and alloys thereof.

7. Holding device and billets according to claim 1, wherein at least one of said end walls contains ceramic material.

8. Holding device and billets according to claim 7, wherein at least one of said end walls contains a ceramic material selected from the group consisting of $Al_2O_3$, $Al_3O_4$, BN, SiC, $Si_3N_4$, MgO, TiO, $ZrO_2$, stabilized glasses and stabilized refractory cements.

9. Holding device and billets according to claim 8, wherein said stabilized glasses and stabilized refractory cements comprise yttrium stabilized $ZrO_2$.

10. Holding device and billets according to claim 7, wherein the end walls contain fiber-reinforced ceramic material.

11. Holding device and billets according to claim 10, wherein the fibers of the fiber-reinforced ceramic material are selected from the group consisting of SiC, $Al_2O_3$, glass and carbon.

12. Holding device and billets according to claim 1, wherein the billet exhibits a round to oval or polygonal cross-section, and wherein the inner diameter of the body is 0.2 to 10 mm larger than the diameter of the billet, and wherein the length of the shell is larger than the maximum length of the billet.

13. Holding device and billets according to claim 12, wherein the length of the shell is 1 to 10 mm larger than the maximum length of the billet.

14. Holding device and billets according to claim 1, wherein the height of the shell is up to 60 mm greater than half the average billet diameter.

15. Holding device and billets according to claim 1, wherein said billets are billets of a metal alloy which has thixotropic properties, up to a temperature range in which the billets are in a semi-solid state, and wherein said holding device is operative to hold said billets in an induction furnace, and transport said billets until casting.

16. Holding device and billets according to claim 1, including a ring-shaped closure at each end which forms the stops for the end walls.

* * * * *